US010024127B2

(12) United States Patent
Plante et al.

(10) Patent No.: US 10,024,127 B2
(45) Date of Patent: Jul. 17, 2018

(54) ONE-TRIP CUT AND PULL SYSTEM AND APPARATUS

(71) Applicant: HydraWell Inc., Houston, TX (US)

(72) Inventors: Mark Plante, Tomball, TX (US); Martin P. Coronado, Cypress, TX (US); Markus Iuell, Sola (NO); Luis Garcia, Kingwood, TX (US); Rodney Bennett, Houston, TX (US)

(73) Assignee: HydraWell Inc., Houston, TX (US)

( * ) Notice: Subject to any disclaimer, the term of this patent is extended or adjusted under 35 U.S.C. 154(b) by 55 days.

(21) Appl. No.: 15/034,830

(22) PCT Filed: Nov. 13, 2014

(86) PCT No.: PCT/US2014/065494
§ 371 (c)(1),
(2) Date: May 5, 2016

(87) PCT Pub. No.: WO2015/073695
PCT Pub. Date: May 21, 2015

(65) Prior Publication Data

US 2016/0265295 A1 Sep. 15, 2016

Related U.S. Application Data

(60) Provisional application No. 61/903,641, filed on Nov. 13, 2013.

(51) Int. Cl.
*E21B 33/12* (2006.01)
*E21B 29/00* (2006.01)
(Continued)

(52) U.S. Cl.
CPC ..... *E21B 29/002* (2013.01); *E21B 23/002* (2013.01); *E21B 23/06* (2013.01);
(Continued)

(58) Field of Classification Search
CPC ..... E21B 29/002; E21B 23/06; E21B 23/002; E21B 31/16; E21B 31/20; E21B 33/10; E21B 33/1216; E21B 34/12; E21B 34/14
See application file for complete search history.

(56) References Cited

U.S. PATENT DOCUMENTS 2,203,011 A 4/1937 Ellis et al.
2,786,534 A 3/1957 Page, Jr.
(Continued)

FOREIGN PATENT DOCUMENTS

EP 3068970 A2 9/2016
GB 2066328 A 7/1981
(Continued)

OTHER PUBLICATIONS

International Search Report, PCT/US2014/065494, dated Feb. 19, 2015, 2 pages.
(Continued)

*Primary Examiner* — Yong-Suk Ro
(74) *Attorney, Agent, or Firm* — Wick Phillips Gould & Martin, LLP

(57) ABSTRACT

Disclosed embodiments may relate to devices or tools for diverting flow within a wellbore. For example, disclosed tool embodiments may allow for more efficiently cutting and pulling of casing from a wellbore during well abandonment operations, since diverting fluid flow as disclosed may allow for a single tool string trip to allow the flow patterns for both cutting and cleanup.

20 Claims, 3 Drawing Sheets

(51) Int. Cl.

| | |
|---|---|
| ***E21B 23/12*** | (2006.01) |
| ***E21B 33/126*** | (2006.01) |
| ***E21B 33/10*** | (2006.01) |
| ***E21B 34/12*** | (2006.01) |
| ***E21B 31/16*** | (2006.01) |
| ***E21B 34/14*** | (2006.01) |
| ***E21B 23/06*** | (2006.01) |
| ***E21B 31/20*** | (2006.01) |

(52) U.S. Cl.
CPC ..... *E21B 31/16* (2013.01); *E21B 31/20* (2013.01); *E21B 33/10* (2013.01); *E21B 33/126* (2013.01); *E21B 34/12* (2013.01); *E21B 34/14* (2013.01)

(56) References Cited

U.S. PATENT DOCUMENTS

| | | | | |
|---|---|---|---|---|
| 3,771,603 | A | 11/1973 | Crowe | |
| 4,712,613 | A * | 12/1987 | Nieuwstad | E21B 21/10 166/187 |
| 5,181,569 | A | 1/1993 | McCoy et al. | |
| 6,386,292 | B1 * | 5/2002 | Bland | E21B 23/01 166/142 |
| 7,665,532 | B2 | 2/2010 | Cook et al. | |
| 2004/0020641 | A1 * | 2/2004 | Budde | E21B 33/16 166/193 |
| 2009/0078407 | A1 * | 3/2009 | Carro | E21B 33/126 166/187 |
| 2010/0089583 | A1 | 4/2010 | Xu et al. | |
| 2010/0263873 | A1 | 10/2010 | Turner et al. | |
| 2013/0048268 | A1 | 2/2013 | Crow et al. | |
| 2013/0248204 | A1 | 9/2013 | Tessari et al. | |
| 2014/0251616 | A1 | 9/2014 | O'Rourke et al. | |
| 2016/0130901 | A1 | 5/2016 | Coronado et al. | |

FOREIGN PATENT DOCUMENTS

| | | | |
|---|---|---|---|
| WO | 2015073695 | A1 | 5/2015 |
| WO | 2016077435 | A1 | 5/2016 |

OTHER PUBLICATIONS

PCT/US2015/060114, PCT International Search Report, dated Mar. 31, 2016, 4 pages.

PCT/US2015/060114, PCT Written Opinion, dated Mar. 31, 2016, 5 pages.

PCT/US2014/065494, Written Opinion of the International Searching Authority, dated Feb. 19, 2015, 5 pages.

PCT/US2014/065494, International Preliminary Report on Patentability, dated May 17, 2016, 6 pages.

Europe Patent Application No. 14862576.7, Extended European Search Report, dated Jun. 16, 2017, 11 pages.

U.S. Appl. No. 14/938,065, Office Action, dated Oct. 16, 2017, 9 pages.

PCT/US2015/060114, International Preliminary Report on Patentability, dated May 16, 2017, 6 pages.

* cited by examiner

ONE-TRIP CUT AND PULL SYSTEM AND APPARATUS

CROSS-REFERENCE TO RELATED APPLICATIONS

This application is the national stage application of and claims priority to International Application Serial No. PCT/US2014/065494, filed on Nov. 13, 2014, and entitled "ONE-TRIP CUT AND PULL SYSTEM AND APPARATUS", which claims priority to U.S. Provisional Patent Application Ser. No. 61/903,641 entitled "One-Trip Cut and Pull System and Apparatus" and filed on Nov. 13, 2013 (such that this application also claims priority back to U.S. Provisional Patent Application Ser. No. 61/1903,641), both of which are incorporated herein by reference in their entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Applicants have developed tool embodiments allowing for diversion of fluid flow within a wellbore/tool string. Such disclosed embodiments may allow for more efficient ways to remove casing from wellbores during well abandonment operations, for example. By way of illustration, disclosed embodiments may relate to tools to assist in cutting and removing casing in advance of extraction, allowing for the related cutting and pulling operations to take place during a single trip of the tool string downhole. Persons of skill will appreciate the advantages arising from such tool embodiments described herein.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
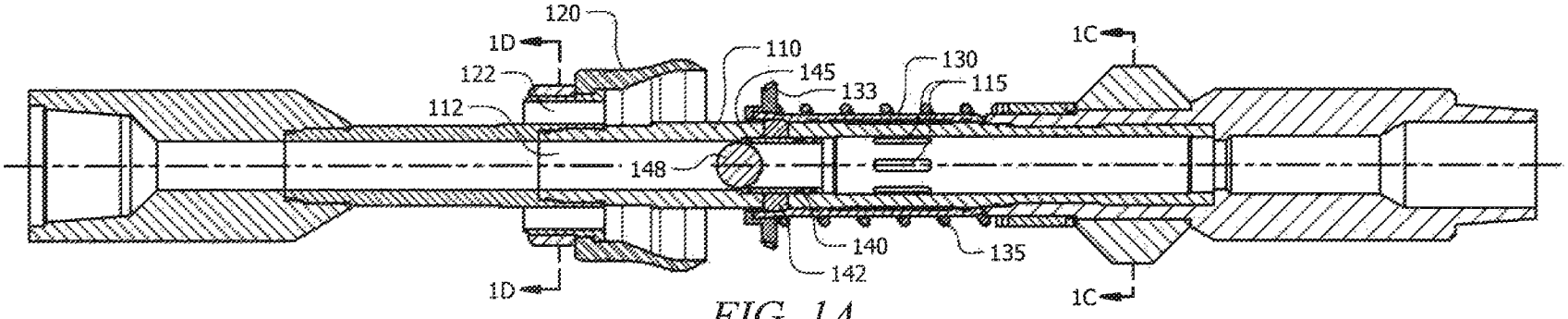
FIG. 1A illustrates a longitudinal cross-sectional view of an exemplary tool embodiment in its first position/configuration, just as a ball has been dropped to plug the activation sleeve (but before the fluid pressure in the longitudinal bore moves the activation sleeve from its first position to its second position)

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application;

The specification may refer to up or down or the like, with "up" or "upper" or "above" or similar terms meaning towards the earth's surface or towards the entrance of a wellbore, and "down" or "lower" or "below" or similar terms meaning towards the bottom or terminal end of a wellbore, as will be understood by persons skilled in the art field;

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention important y, such phrases do not necessarily refer to the same embodiment);

If the specification describes something as "exemplary" or an "example," it should be understood that refers to a non-exclusive example;

The terms "about" or approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" or other such language) be included or have a characteristic, that particular component or feature is not required to be included or to have the characteristic. Such component or feature may be optionally included in some embodiments, or it may be excluded.

Disclosed embodiments relate generally to tool embodiments for diversion of fluid flow, typically within a wellbore and/or tool string. In some instances, typical embodiments of such diverter tools may relate to casing cutting and pulling operations as currently performed in well abandonment operations. Typically, the casing is cut at a predetermined depth where the casing string above must be removed from the well, so that adequate well barriers can be put in place to secure the well. The casing cut may be performed using an expanding-blade cutter, which typically may be rotated by a positive displacement mud motor run directly above the cutter in the tool string. The motor typically is powered by fluid circulated through the drill pipe work string (e.g. tool string), which passes through the motor. This motor's stator/rotor combination may create rotation and torque to power the cutter. Fluid typically then exits the cutter when in operation and is circulated back up the casing to the surface. Once the cut has been completed, the cutting string would conventionally be removed from the well. The next operation typically might be to circulate fluid around the outside of the casing which was previously cut to remove old drilling mud and any solids which may prevent the casing from being removed from the well. To perform this operation conventionally (e.g. without a disclosed diverter tool), a second tool string would be run in the well, which includes a casing pack off tool and a casing spear. Once the spear is latched into the casing, the casing pack off prevents fluid circulation up the hole through the annulus between the casing that has been cut and the drill pipe. So, as fluid is pumped down the drill pipe it can only go out through the cut in the casing and around the outside of the casing that was cut. This would provide the necessary circulation around the outside of the casing to remove mud, debris and gas before pulling the casing. Once clean out circulation has been completed, the spear and jars would be used to pull the casing from the well. The conventional process described above is completed in two drill pipe/tool trips into the well, due to the need to circulate fluids up the casing-drill pipe annulus while making the casing cut, while then needing this annulus to be closed off to allow clean-up circulation around the outside of the casing after the cut has been made. The presently disclosed diverter tool embodiments allow for this operation to be performed in only one trip using a selective annular sealing device that would allow circulation in the casing-drill pipe annulus during the cut, but then be able to seal off the annulus (to prevent fluid upflow) after the cut has been made. Performing this cutting and pulling operation in only one trip should save substantial rig time and be more cost effective for the operator.

Disclosed embodiments provide the selective annular seal to perform this operation in one trip, for example using an exemplary diverter tool as shown in FIGS. 1A-D. Typically, the tool device would be run above the motor, but below the spear, which is latched into the casing to be pulled. Circulation up the annulus during the cutting operation passes through the tool via annular flow passages below/through the packer cup (annulus) seal. Once the cut has been completed (such that fluid flow up to the surface should only be through the cut and around the casing (e.g. not having fluid flow to the surface through the annular space)), a ball or other plug element can be dropped through the drill pipe/tool (e.g. in the bore of the tool string) to land in the activation sleeve in the device. Applied hydraulic pressure through the drill pipe (e.g. bore) may then shear retaining screws in the activation sleeve, allowing the activation sleeve to travel downwards. The downward motion of the activation sleeve would thereby remove the support for the retaining dog segments in the tool, allowing them to collapse inward. The inward movement of the retaining dog segments would then allow the seal sleeve to move upwards due to the force from a compressed compression spring (or other biasing force). The upward movement of the seal sleeve drives the molded seal into sealing engagement with the packer cup, thus closing off the annular flow channels through the packer cup (and it should be understood that the term "packer cup" as used in this application is intended to be broadly considered as any annulus seal element and is not merely limited to any specific packer cup embodiment, so the terms "packer cup" and "annulus seal element" may be used interchangeably). This essentially closes off possible flow up through the casing-drill pipe annulus. Flow down the drill pipe is now forced to enter the casing cut (e.g. through ports in the tool's housing exposed by upward movement of the seal sleeve) and travel back to the surface along the outside of the casing that is to be removed, as desired. Once circulated clean, the casing can be pulled from the well using the casing spear and jars run higher in the string. The closing mechanism of the tool prevents flow up the annulus once closed (e.g. due to sealing engagement of the molded seal with the packer cup), but may allow flow down the annulus by simply lifting the molded seal off the packer cup against the spring force. This feature may be useful to prevent possible fluid swabbing when the tool is removed from the casing when in the closed position (previously activated).

Figure 1B:
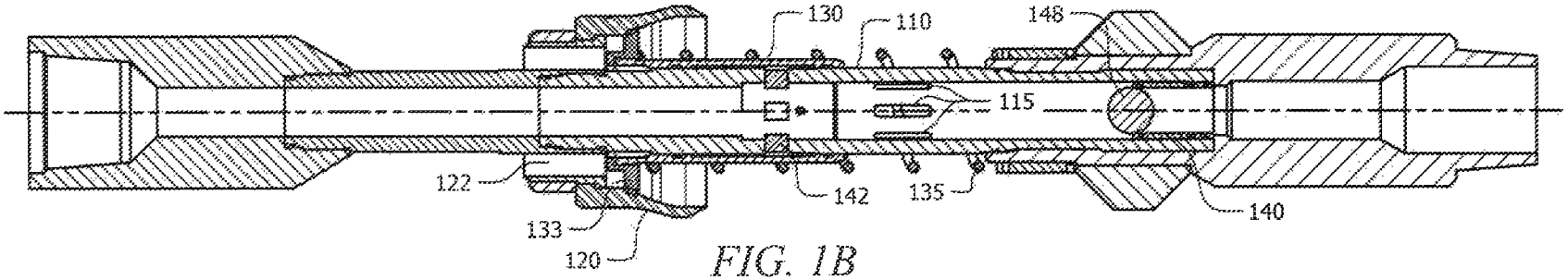
FIG. 1B illustrates a longitudinal cross-sectional view of the tool of FIG. 1A in its second position/configuration, once fluid pressure in the bore has driven the activation sleeve (now closed due to insertion of the ball/plug) from its first position to its second position, thereby allowing inward retraction of the retaining dog elements and thereby releasing the seal sleeve so that the spring can drive the seal sleeve to its second position (in which the seal engages the packer cup to seal the annular flow channels therethrough); in addition to sealing the packer cup to prevent annular fluid flow therethrough, the upward movement of the seal sleeve to its second position opens the one or more ports in the housing of the tool, thereby allowing fluid communication between the bore and the annular space between the tool/housing and the cased wellbore.
Figure 1C:
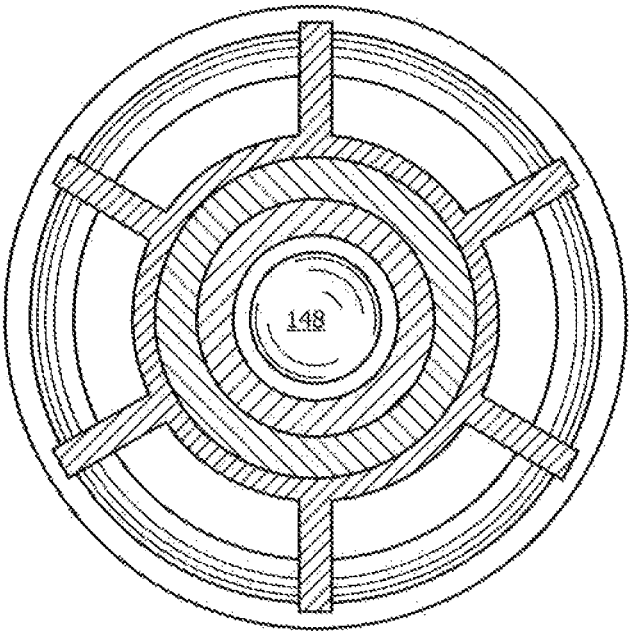
FIG. 1C illustrates a cross-sectional view of the embodiment of FIG. 1A taken at the indicated location.
Figure 1D:
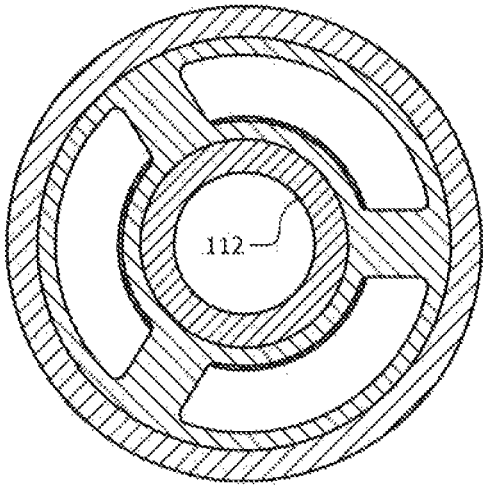
FIG. 1D illustrates a cross-sectional view of the embodiment of FIG. 1A taken at the indicated location.

FIGS. 1A-D illustrate such an exemplary diverter tool, which for example might be used in a downhole tool string within a cased wellbore. FIG. 1A shows the exemplary tool in its first configuration (with the activation sleeve in its first activation position and the seal sleeve in its first seal position), thereby preventing radial fluid flow from the bore outward through the housing into the annular space, while allowing longitudinal annular flow upward in the annular space through annular flow channels (e.g. allowing annular flow upward past the tool packer cup). FIG. 1B shows the same tool in its second configuration (with the activation sleeve in its second activation position and the seal sleeve in its second seal position), thereby allowing radial fluid flow from the bore outward through the housing into the annular space, while preventing longitudinal annular flow upward in the annular space through the annular flow channels (e.g. preventing annular flow upward past the tool packer cup).

The tool of FIGS. 1A-B comprises a housing 110 (typically having an outer diameter which is smaller than the inner diameter of the cased wellbore to be serviced) adapted to be made up as part of the tool string, with a longitudinal bore 112 therethrough and one or more ports 115 penetrating (radially) through the housing 110 (operable to allow fluid flow from the bore 112 to the annular space between the housing and the casing when open); a packer cup 120 affixed to the exterior of the housing 110 above the one or more ports 115 and operable to engage the casing (e.g. cased wellbore) and having one or more annular flow channels 122 therethrough; a seal sleeve 130 slidably disposed for longitudinal movement with respect to (e.g. outside) the housing 110 between a first (lower) seal position and a second (upper) seal position; a molded seal 133 (or other seal element), shaped to be operable to engage the packer cup 120 to seal the annular flow therethrough and attached to the seal sleeve 130 such that movement of the seal sleeve 130 (from its first position to its second position) results in movement of the molded seal 133 (from its first/lower/open position to its second/upper/closed position) (e.g. the seal 133 typically might be located at the top of the seal sleeve 130); an activation sleeve 140 (typically located within the bore 112 of the housing 110) slidably disposed for longitudinal movement with respect to (e.g. within) the housing 110 between a first (upper) activation position and a second (lower) activation position; and a releaseable stop mechanism comprising one or more retaining dog segments 142 operable to move radially within corresponding openings in the housing 110 from a first (outward) radial position to a second (inward) radial position. The packer cup typically is operable to engage (in a sealing manner) the casing (e.g. cased wellbore) and/or the housing. In other words, the packer cup/annulus seal element is typically operable to prevent fluid flow in the annular space between the housing and the cased wellbore (except through open annular flow channels), so that opening or closing the annular flow channels (e.g. based on position of the seal with respect to the annular flow channels) may operate to control annular fluid flow upward past the packer cup.

In FIG. 1A, the first position of the activation sleeve 140 is located to interact with the retaining dog segments 142 (e.g. the opening in the housing for the retaining dog segments, to prevent inward movement of the retaining dog segments) above the ports 115 in the housing (and to hold the retaining dog segments outward sufficiently so that the retaining dogs segments 142 interfere with (e.g. block/prevent) upward movement of the seal sleeve 130), and in FIG. 1B the second position of the activation sleeve 140 is located below the ports 115 in the housing (to no longer interact with the retaining dog segments 142, thereby allowing the retaining dog segments freedom to move inward (for example, out of interference with the seal sleeve, thereby releasing the seal sleeve 130 for longitudinal movement), with the activation sleeve typically engaging a lip (e.g. necked-down portion of the bore) that may operate as a lower stop at its second position). In FIG. 1A, the first position of the seal sleeve 130 covers the ports 115 in the housing (thereby closing/sealing the ports) and locates the molded seal 133 below the packer cup 120 (in an open/non-engaging/non-sealing position, allowing annular flow upward through the annular flow channels 122), and in FIG. 1B the second position of the seal sleeve 130 uncovers the ports 115 in the housing (to open the ports and allow fluid communication between the bore and the annular space) and locates the molded seal 133 to engage the packer cup 120 to seal the annular flow channels 122 through the packer cup. In FIG. 1A, the first position of the retaining dog segments 142 is located to interact with both the activation sleeve 140 and the seal sleeve 130 (and is typically located between the activation sleeve and the seal sleeve), with the retaining dog engaging the seal sleeve to hold it in its first position; and in FIG. 1B the second position of the retaining dog segments is retracted inward radially to release the seal sleeve (such that the retaining dog in its second position does not interact with either the activation sleeve or the seal sleeve, thereby allowing the seal sleeve freedom to move). Typically, the activation sleeve 140 is initially releasably held in its first position (e.g. by one or more shear pins/screws 145) until sufficient activating force releases it; the retaining dog segments 142 is initially held in its first position by the activation sleeve 140 in its first position (and moves from its first position to its second position when the activation sleeve moves from its first position to its second position); and the seal sleeve 130 is held in its first position by the retaining dog segments 142 in its first position, and the seal sleeve 130 is biased towards its second position (e.g. by a spring 135) (such that inward movement of the retaining dog segments to its second position releases the seal sleeve, allowing the seal sleeve to move to its second position due to biasing (e.g. spring) force).

Typically, activation of the activation sleeve 140 from its first position to its second position causes the activation sleeve 140 to slide downward in the housing 110 to a location below the ports 115, thereby releasing the retaining dog segments 142 to slide inward radially from its first position to its second position, thereby releasing the seal sleeve 130 so that the biasing force can slide the seal sleeve 130 upward on the housing 110 from its first position to its second position (in sealing contact with the packer cup to prevent fluid flow upward through the annular flow channels). So, activation of the activation sleeve 140 from its first position to its second position typically operates to shift/move/transform the tool from its first configuration to its second configuration. A ball 148 or plug element operable to seal the activation sleeve 140 may be used (in conjunction with fluid flow in the bore) to activate the activation sleeve, wherein the hall 148 may he operable to be placed in the upper end of the activation sleeve 140 to seal the sleeve (to prevent or restrict fluid flow through the opening of the activation sleeve), such that fluid flow through the bore then may drive the activation sleeve 140 from its first position to its second position.

In FIG. 1A, prior to placement of the ball plug 148 (e.g. without the ball 148 in place), fluid flows through the bore 112 (from the top of the tool to the bottom of the tool—e.g. all fluid in the bore flows out the bottom of the tool), but after placement of the ball plug 148 in FIG. 1B (e.g. after placement of the ball and application of sufficient fluid pressure in the bore to drive the activation sleeve to its second position), fluid flows through the ports 115 in the housing. Prior to placement of the ball plug 148, the tool is operable to allow fluid flow in the annular space between the housing and the casing up to the surface, but after placement of the ball plug 148 (e.g. after the ball is pumped to shift the activation sleeve to its second position), the tool no longer allows annular fluid flow upward past the sealed packer cup 120. Typically, the activation sleeve 140 is releasably held in its first position by shear pins or screws 145. Also, the seal sleeve 130 is typically biased upward towards its second position by a spring 135. Typically, the packer cup substantially retains its outward shape/diameter and is typically not designed to be collapsible or expandable (in other words, the packer cup typically maintains a substantially fixed outer diameter during deployment and operation of the tool). The outer diameter of the packer cup is typically approximately equal to the inner diameter of the casing, and is operable to sealingly engage with the casing (so that when the annular flow channels are closed, no fluid may flow upward past the packer cup).

In some alternate embodiments (similar to the example of FIGS. 1A-B), the activation sleeve 140 in its first position might also extend downward sufficiently to cover/close the ports 115 in the housing. In such embodiments, the seal sleeve 130 in its first position may not cover the ports 115 in some embodiments (although in other embodiments, it may). And in some embodiments, some other releasable stop mechanism (other than retaining dog segments) might be used to releasably fix/hold the seal sleeve 130 in its first position (with such releasable stop mechanism typically being selectively released by movement of the activation sleeve from its first position to its second position in some embodiments). In yet other embodiments, there might not be an activation sleeve at all, but rather some other means to activate shifting of the tool from its first configuration to its second configuration (e.g. some other means to selectively release the releasable stop mechanism, in order to allow movement of the seal sleeve from its first position to its second position). In such embodiments without an activation sleeve, the seal sleeve would typically cover the ports 115 in the housing when located in its first seal position. Furthermore, some alternate embodiments may have annular flow channels that pass through a portion of the housing, rather than the packer cup. In other words, in such embodiments, the annular flow channels could pass through either the packer cup or a portion of the housing (for example, a laterally extending portion of the housing) or (optionally) any other portion of the tool device, so long as the annular flow channels are capable of allowing longitudinal annular fluid flow in the annular space upward (for example, above the packer cup and/or upward to or toward the surface above the tool) when open. And as noted above, the packer cup as used herein is to be considered in the broad sense as the equivalent of an annulus seal element (such that any annulus seal element might be used for various embodiments). Persons of skill will understand such alternate embodiment modifications (from FIGS. 1A-B) based on the description above.

The diverter tool (for example, as shown in FIGS. 1A-D) typically is used in a tool string, and (in addition to the diverter tool) the tool string may further comprise a cutter (for example, an expanding-blade cutter) and a motor, wherein the motor powers the cutter and the motor is operable to be powered by fluid flow through the tool string. In some embodiments, the tool string may further comprise a spear (or other pulling tool for extracting the cut casing). In some embodiments, the motor, cutter, and/or spear might be incorporated into the diverter tool itself. Typically, the motor and cutter are located below the ports, the seal sleeve, and/or the activation sleeve, and the motor is powered by fluid flow through the bore, which then circulates back to the surface through the annular space (between the tool string and the casing of the cased wellbore). So, the cutter cuts the casing when the tool is in its first configuration (e.g. before the ball is placed in the activation sleeve, since this allows the fluid flow through the bore to power the motor to drive the cutter), and once the ball 148 is in place sealing the activation sleeve 140 and moving the activation sleeve 140 and therefore the seal sleeve 130 from their first to second positions, fluid flows downward through the bore 112 to the ports 115, outward through the ports 115 to the annular space, downward in the annular space (below the sealed packer cup) to exit the casing at the cut, thereby to flow back up towards the surface along the outside of the casing. In some instances, a bottom seal may be used for the bottom of the wellbore (or somewhere below the cut in the wellbore), to facilitate fluid flow upward outside of the casing after cutting.

Figure 2:
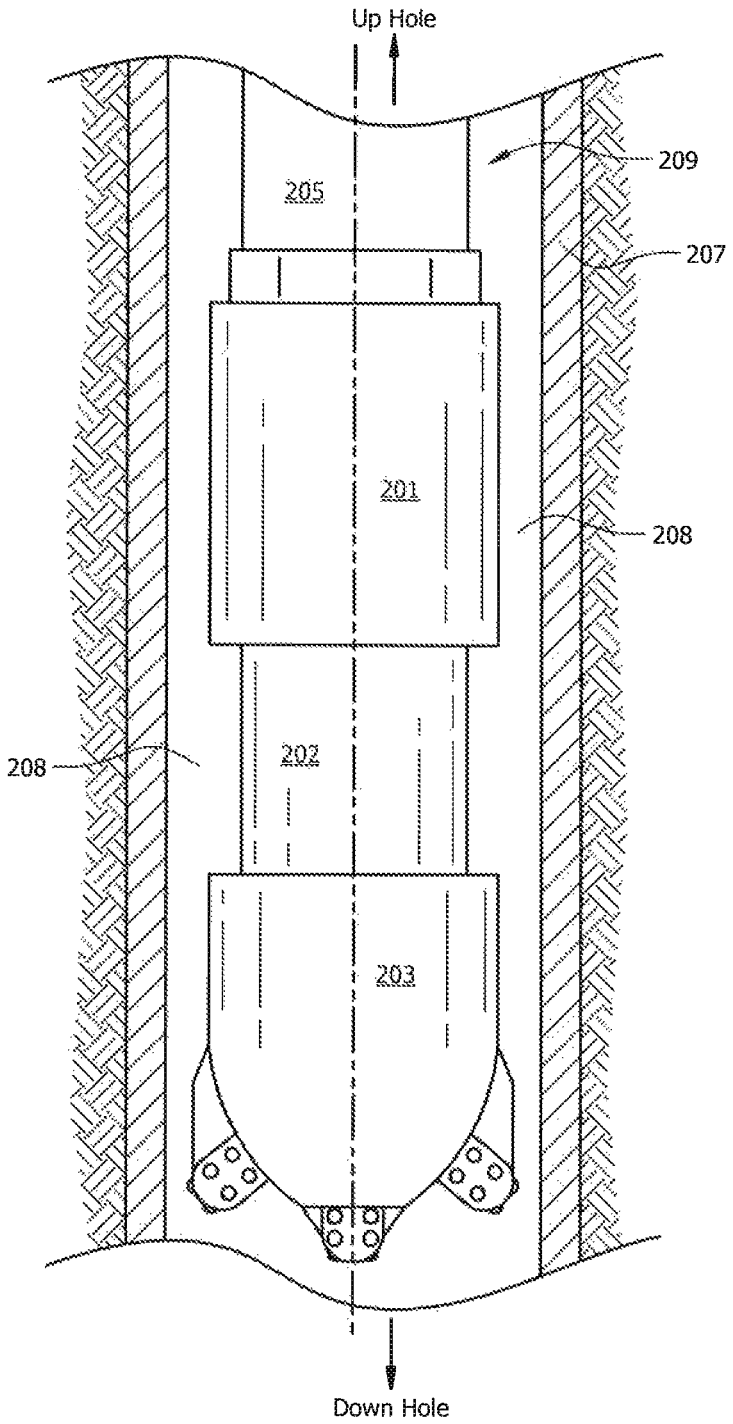
FIG. 2 is a schematic diagram showing the placement of an exemplary diverter tool (for example, as shown in FIG. 1A-D) within an exemplary tool string in a cased wellbore.

FIG. 2 illustrates schematically typical placement of such a diverter tool 201 within a tool string 209 in a cased wellbore (or casing) 207 (relative to other tool string elements). For example, in the embodiment of FIG. 2, the diverter tool 201 is located above the motor 202 and cutter 203 in the tool string 209, but typically would be located below the spear 205 (or other pulling tool for extracting the casing from the wellbore once cut). It should be noted that FIG. 2 merely shows the relative location of the specific tools/elements in the tool string in relation to one another (e.g. which is above and which is below); some embodiments may have other tools/elements interposed between the listed tools/elements. So in the tool string of FIG. 2, prior to placement of the ball in the bore of the tool string, fluid flow through the bore may power the motor 202 to drive the cutter 203 (cutting the casing). Fluid during cutting would typically flow downhole through the longitudinal bore in the tool string (all the way to the bottom—e.g. below the cutter) and then upward in the annular space 208 between the tool string 209 and the casing 207 (e.g. circulating back to the surface). Once the casing 207 has been cut and cleanout is desired, the ball (or other plug element) can be inserted into the activation sleeve of the diverter tool 201. Then, fluid flow in the bore of the tool string 209 can be used to force the activation sleeve downward into its second position (while also sealing the bore). As described above with respect to FIGS. 1A-B, this results in the seal sleeve moving upward to seal the annular space 208 (preventing further circulation of fluid up the annular space 208 to surface), while also opening ports in the housing to allow radial fluid communication from the bore to the annular space 208 (beneath the sealed portion of the annular space). In this configuration, fluid may then circulate upward along the outside of the casing 207 through the cut in the casing (for example, flowing from the bore, through the ports, downward in the annular space, through the cut in the casing, and upward along the outside of the casing), which may allow for cleanout of old drilling mud, solids, etc. that might complicate removal of the casing 207 from the wellbore. A drilling tool string 209 configured similar to that shown in FIG. 2 would thereby allow for cutting and pulling operations (to remove casing during well abandonment procedures for example) using only one trip of the tool string downhole.

Having described above various product/device/tool and method embodiments (especially those shown in the figures), various additional embodiments may include, but are not limited to the following:

In a first embodiment, a tool for use in a downhole tool string within a cased wellbore, comprising: a housing adapted to be made up as part of the tool string, with a longitudinal bore therethrough and one or more ports penetrating through the housing and operable to allow radial fluid flow outward from the bore to an annular space; a packer cup affixed to the exterior of the housing above the one or more ports and operable to engage the cased wellbore and having one or more annular flow channels therethrough; a seal sleeve located on an exterior of the housing and slidably disposed for longitudinal movement with respect to the housing between a first seal position and a second seal position; a seal shaped to be operable to engage the packer cup to seal annular flow therethrough and attached to the seal sleeve, such that movement of the seal sleeve from the first seal position to the second seal position results in movement of the seal into sealing engagement with the packer cup; an activation sleeve located on an interior of the housing and slidably disposed for longitudinal movement with respect to the housing between a first activation position and a second activation position; and one or more retaining dog segments operable to move radially within corresponding openings in the housing from a first radial position to a second radial position; wherein: the first activation position of the activation sleeve is located to interact with the one or more retaining dog segments above the ports in the housing, and the second activation position of the activation sleeve is located below the ports in the housing and no longer interacts with the retaining dog segments; the first seal position of the seal sleeve covers the ports in the housing and locates the seal below the packer cup, and the second seal position of the seal sleeve uncovers the ports in the housing to allow fluid communication between the bore and the annular space and locates the seal to engage the packer cup to seal the annular channels through the packer cup; the first radial position of the one or more retaining dog segments interacts with both the activation sleeve and the seal sleeve, with the one or more retaining dog segments engaging the seal sleeve: to hold the seal sleeve in the first seal position, and the second radial position of the one or more retaining dog segments is retracted inward radially to release the seal sleeve; the activation sleeve is initially releasably held in its first activation position; the one or more retaining dog segments are initially held in the first radial position by the activation sleeve in the first activation position and moves from the first radial position to the second radial position when the activation sleeve moves from the first activation position to the second activation position; and the seal sleeve is held in the first seal position by the one or more retaining dog segments in the first radial position, and the seal sleeve is biased towards the second seal position, such that radial movement of the one or more retaining dog segments to the second radial position releases the seal sleeve and allows the seal sleeve to move to the second seal position.

In a second embodiment, the tool of the first embodiment wherein activation of the activation sleeve from the first activation position to the second activation position causes the activation sleeve to slide downward in the housing to a location below the ports, thereby releasing the one or more retaining dog segments to slide inward radially from the first radial position to the second radial position, thereby releasing the seal sleeve so that the biasing force can slide the seal sleeve upward on the housing from the first seal position to the second seal position. In a third embodiment, the tool of embodiments 1-2 further comprising a ball operable to seal the activation sleeve, wherein the ball is operable to be placed in an upper end of the activation sleeve to seal the activation sleeve, such that fluid flow through the bore may then drive the activation sleeve from the first activation position to the second activation position, In a fourth embodiment, the tool of embodiment 3 wherein prior to placement of the ball, fluid is operable to flow through the bore from a top of the tool to a bottom of the tool., but after placement of the ball, fluid is operable to flow through the ports in the housing. In a fifth embodiment, the tool of embodiments 3-4 wherein prior to placement of the ball, the tool is operable to allow fluid flow in the annular space between the housing and the cased wellbore up to the surface, but after placement of the ball, the tool no longer allows annular fluid flow upward past the sealed packer cup. In a sixth embodiment, the tool of embodiments 1-5 wherein the activation sleeve is releasably held in its first activation position by shear pins or screws. In a seventh embodiment, the tool of embodiments 1-6 wherein the seal sleeve is biased upward towards its second seal position by a spring.

In an eighth embodiment, the tool (or alternatively a tool string comprising the tool) of embodiments 1-7 further comprising a cutter (for example, an expanding-blade cutter) and a motor, wherein the motor powers the cutter and the motor is operable to be powered by fluid flow through the tool string. In a ninth embodiment, the tool of embodiment 8 wherein the motor and cutter are located below the ports, the seal sleeve, and the activation sleeve; and wherein the motor is powered by fluid flow through the bore, which then circulates back to the surface through the annular space (between the tool string and the casing of the cased wellbore). In a tenth embodiment, the tool of embodiments 8-9 wherein the cutter cuts the casing before the ball is placed in the activation sleeve (since this allows the fluid flow through the bore to power the motor to drive the cutter), and wherein once the ball is in place sealing the activation sleeve and moving the activation sleeve and therefore the seal sleeve from their first to second positions, fluid flows downward through the bore to the ports, outward through the ports to the annular space, downward in the annular space (below the sealed packer cup) to exit the casing at the cut, thereby to flow back up towards the surface along an outside of the casing. In an eleventh embodiment, the tool of embodiments 8-10 further comprising a spear (or other pulling tool for extracting the cut casing). In a twelfth embodiment, the tool of embodiments 1-11 further comprising a bottom seal for the bottom of the wellbore.

In a thirteenth embodiment, a tool for use in a downhole tool string within a cased wellbore, comprising: a housing adapted to be made up as part of the tool string, with a longitudinal bore therethrough and one or more ports penetrating through the housing and operable to allow radial fluid flow outward from the bore to the annular space; an annulus seal element (e.g. a packer cup) affixed to an exterior of the housing above the one or more ports and operable to engage the cased wellbore; one or more annular flow channels extending (e.g, longitudinally) through either the annulus seal element (e.g, packer cup) or the housing and operable when open to allow annular flow in the annular space upward beyond the annulus seal element (e.g. upward to the surface); a seal sleeve located on the exterior of the housing and slidably disposed for longitudinal movement with respect to the housing between a first seal position and a second seal position; a seal shaped to be operable to engage with the annular flow channels to seal annular flow therethrough and attached to the seal sleeve, such that movement of the seal sleeve from the first seal position to the second seal position results in movement of the seal into sealing engagement with the annular flow channels; and a releasable stop mechanism operable to releasably hold the seal in the first seal sleeve position (and selectively operable to release the seal sleeve to allow movement of the seal sleeve to the second seal position); wherein: the first seal position of the seal sleeve locates the seal so that it is not in sealing engagement with the annular flow channels, and the second seal position of the seal sleeve locates the seal to sealingly engage the annular flow channels; and the seal sleeve is biased towards the second seal position.

In a fourteenth embodiment, the tool of embodiment 13 wherein the first seal position of the seal sleeve covers the ports in the housing, while the second seal position of the seal sleeve uncovers the ports in the housing to allow fluid communication between the bore and the annular space. In a fifteenth embodiment, the tool of claim 13-14 wherein the releasable stop mechanism comprises one or more retaining dog segments operable to move radially within corresponding openings in the housing from a first radial position to a second radial position, and wherein the seal sleeve is held in the first seal position by the one or more retaining dog segments in the first (outward) radial position (and is released and operable to move to the second seal position when the retaining dog segments are in the second (inward) radial position). In a sixteenth embodiment, the tool of embodiments 13-15 further comprising an activation sleeve located on an interior of the housing and slidably disposed for longitudinal movement with respect to the housing between a first activation position and a second activation position, in a seventeenth embodiment, the tool of embodiment 16 wherein the activation sleeve in the first activation position covers/seals the ports in the housing, and wherein the activation sleeve in the second activation position does not cover/seal the ports. In an eighteenth embodiment, the tool of claims 16-17 wherein the activation sleeve is releasably held (for example by shear pins or screws) its first activation position. In a nineteenth embodiment, the tool of embodiments 16-18 wherein the activation sleeve interacts with the releasable stop mechanism (e.g. the one or more retaining dog segments), and wherein movement of the activation sleeve from the first activation position to the second activation position operates to release the releasable stop mechanism (e.g. to allow radial (inward) movement of the one or more retaining dog segments) to release the seal sleeve and allow movement of the seal sleeve from the first seal position to the second seal position, In a twentieth embodiment, the tool of embodiments 13-19 wherein the tool has a first configuration and a second configuration;

wherein when the tool is in the first configuration, the ports are closed/sealed and the annular flow channels are open; and wherein when the tool is in the second configuration, the ports are open and the annular flow channels are closed/sealed. It should also be understood that embodiments 1-12 could also essentially depend from embodiments 16-20 as well, resulting in yet other additional embodiments based on embodiments 13-20 but also having one or more elements/limitations from embodiments 1-12 (since, for example, those earlier embodiments tend to relate to narrower embodiments, but could also be used with broader embodiments 13-20 in some contexts).

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. In the claims, any designation of a claim as depending from a range of claims (for example #-##) would indicate that the claim is a multiple dependent claim based on any claim in the range (e.g. dependent on claim # or claim ## or any claim therebetween). Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is riot to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

What is claimed is:

1. A tool for use in a downhole tool string within a cased wellbore, comprising:

a housing adapted to be made up as part of the tool string, with a longitudinal bore therethrough and one or more ports penetrating through the housing and operable to allow radial fluid flow outward from the bore to an annular space;

an annulus seal element affixed to an exterior of the housing above the one or more ports (115) and operable to engage the cased wellbore;

one or more annular flow channels extending longitudinally through either the annulus seal element or the housing and operable when open to allow annular flow in the annular space upward beyond the annulus seal element;

a seal sleeve located on the exterior of the housing and slidably disposed for longitudinal movement with respect to the housing between a first seal position and a second seal position;

a seal shaped to be operable to seal the annular flow channels and attached to the seal sleeve, such that movement of the seal sleeve from the first seal position to the second seal position results in movement of the seal into sealing engagement with the annular flow channels; and a releasable stop mechanism operable to releasably hold the seal sleeve in the first seal position;

wherein:

the first seal position of the seal sleeve locates the seal so that it is not in sealing engagement with the annular flow channels, and the second seal position of the seal sleeve locates the seal to sealingly engage the annular flow channels; and the seal sleeve is biased towards the second seal position.

2. The tool of claim 1, wherein the first seal position of the seal sleeve covers the ports in the housing, while the second seal position of the seal sleeve uncovers the ports in the housing to allow fluid communication between the bore and the annular space.

3. The tool of claim 1, wherein the releasable stop mechanism comprises one or more retaining dog segments operable to move radially within corresponding openings in the housing from a first radial position to a second radial position, and wherein the seal sleeve is held in the first seal position by the one or more retaining dog segments in the first radial position.

4. The tool of claim 1, further comprising an activation sleeve located on an interior of the housing and slidably disposed for longitudinal movement with respect to the housing between a first activation position and a second activation position.

5. The tool of claim 4, wherein the activation sleeve in the first activation position covers the ports in the housing, and wherein the activation sleeve in the second activation position does not cover the ports.

6. The tool of claim 4, wherein the activation sleeve is releasably held in the first activation position.

7. The tool of claim 4, wherein the activation sleeve interacts with the releasable stop mechanism, and wherein movement of the activation sleeve from the first activation position to the second activation position operates to release the releasable stop mechanism to release the seal sleeve and allow movement of the seal sleeve from the first seal position to the second seal position.

8. The tool of claim 1, wherein the tool has a first configuration and a second configuration; wherein when the tool is in the first configuration, the ports are closed and the annular flow channels are open; and wherein when the tool is in the second configuration, the ports are open and the annular flow channels are closed.

9. The tool of claim 1, further comprising a cutter and a motor, wherein the motor powers the cutter and the motor is operable to be powered by fluid flow through the tool string.

10. The tool of claim 9, further comprising a spear.

11. The tool of claim 1, further comprising a bottom seal for the bottom of the wellbore.

12. A tool for use in a downhole tool string within a cased wellbore, comprising:

a housing adapted to be made up as part of the tool string, with a longitudinal bore therethrough and one or more ports penetrating through the housing and operable to allow radial fluid flow outward from the bore to an annular space;

a packer cup affixed to an exterior of the housing above the one or more ports and operable to engage the cased wellbore and having one or more annular flow channels therethrough;

a seal sleeve located on the exterior of the housing and slidably disposed for longitudinal movement with respect to the housing between a first seal position and a second seal position;

a seal shaped to be operable to engage the packer cup to seal annular flow therethrough and attached to the seal sleeve, such that movement of the seal sleeve from the first seal position to the second seal position results in movement of the seal into sealing engagement with the packer cup;

an activation sleeve located on an interior of the housing and slidably disposed for longitudinal movement with respect to the housing between a first activation position and a second activation position; and one or more retaining dog segments operable to move radially within corresponding openings in the housing from a first radial position to a second radial position;

wherein:

the first activation position of the activation sleeve is located to interact with the one or more retaining dog segments above the ports in the housing, and the second activation position of the activation sleeve is located below the ports in the housing and no longer interacts with the retaining dog segments;

the first seal position of the seal sleeve covers the ports in the housing and locates the seal below the packer cup, and the second seal position of the seal sleeve uncovers the ports in the housing to allow fluid communication between the bore and the annular space and locates the seal to engage the packer cup to seal the annular flow channels through the packer cup;

the first radial position of the one or more retaining dog segments interacts with both the activation sleeve and the seal sleeve, with the one or more retaining dog segments engaging the seal sleeve to hold the seal sleeve in the first seal position, and the second radial position of the one or more retaining dog segments is retracted inward radially to release the seal sleeve;

the activation sleeve is initially releasably held in its first activation position;

the one or more retaining dog segments are initially held in the first radial position by the activation sleeve in the first activation position and moves from the first radial position to the second radial position when the activation sleeve moves from the first activation position to the second activation position; and the seal sleeve is held in the first seal position by the one or more retaining dog segments in the first radial position, and the seal sleeve is biased towards the second seal position, such that radial movement of the one or more retaining dog segments to the second radial position releases the seal sleeve and allows the seal sleeve to move to the second seal position.

13. The tool of claim 12, wherein activation of the activation sleeve from the first activation position to the second activation position causes the activation sleeve to slide downward in the housing to a location below the ports, thereby releasing the one or more retaining dog segments to slide inward radially from the first radial position to the second radial position, thereby releasing the seal sleeve so that the biasing force can slide the seal sleeve upward on the housing from the first seal position to the second seal position.

14. The tool of claim 12, further comprising a ball operable to seal the activation sleeve, wherein the ball is operable to be placed in an upper end of the activation sleeve to seal the activation sleeve, such that fluid flow through the bore may then drive the activation sleeve from the first activation position to the second activation position.

15. The tool of claim 14, wherein prior to placement of the ball, fluid is operable to flow through the bore from a top of the tool to a bottom of the tool, but after placement of the ball, fluid is operable to flow through the ports in the housing; and wherein prior to placement of the ball, the tool is operable to allow fluid flow in the annular space between the housing and the cased wellbore up to the surface, but after placement of the ball, the tool no longer allows annular fluid flow upward past the sealed packer cup.

16. The tool of claim 12, wherein the activation sleeve is releasably held in its first activation position by shear pins or screws.

17. The tool of claim 12, wherein the seal sleeve is biased upward towards its second seal position by a spring.

18. The tool of claim 12, further comprising a cutter, a motor, and a spear, wherein the motor powers the cutter and the motor is operable to be powered by fluid flow through the tool string.

19. The tool of claim 18, wherein the motor and cutter are located below the ports, the seal sleeve, and the activation sleeve; and wherein the motor is powered by fluid flow through the bore, which then circulates back to the surface through the annular space.

20. The tool of claim 18, wherein the cutter cuts the casing before the ball is placed in the activation sleeve, and wherein once the ball is in place sealing the activation sleeve and moving the activation sleeve and therefore the seal sleeve from their first to second positions, fluid flows downward through the bore to the ports, outward through the ports to the annular space, downward in the annular space to exit the casing at the cut, thereby to flow back up towards the surface along an outside of the casing.

* * * * *